US005178160A

United States Patent [19]

Gracovetsky et al.

[11] Patent Number: 5,178,160

[45] Date of Patent: Jan. 12, 1993

[54] APPARATUS FOR THE REHABILITATION AND MEASUREMENT OF MUSCULOSKELETAL PERFORMANCES

[75] Inventors: Serge Gracovetsky, St. Lambert; George Papagiannis, Town of Mount Royal, both of Canada

[73] Assignee: Diagnospine Research Inc., Montréal, Canada

[21] Appl. No.: 727,060

[22] Filed: Jul. 8, 1991

[51] Int. Cl.[5] ..... A61B 5/117

[52] U.S. Cl. ..... 128/782; 482/5; 482/8; 482/112

[58] Field of Search ..... 128/774, 782, 781, 25 R; 272/130, 135, 136, DIG. 5; 482/112, 113, 4, 5, 6, 7, 8

[56] References Cited

U.S. PATENT DOCUMENTS

| | | | |
|---|---|---|---|
| 3,587,319 | 6/1971 | Andrews | 272/130 |
| 3,712,294 | 1/1973 | Muller | 128/782 |
| 4,580,778 | 4/1986 | Van Noord | 272/131 |
| 4,605,220 | 8/1986 | Troxel | 272/96 |
| 4,629,185 | 12/1986 | Amann | 272/130 |
| 4,647,038 | 3/1987 | Noffsinger | 272/123 |
| 4,705,271 | 11/1987 | Mandloch et al. | 272/130 |
| 4,738,269 | 4/1988 | Nashner | 128/782 |
| 4,836,538 | 6/1989 | Rice | 272/146 |
| 4,880,230 | 11/1989 | Cook | 272/130 |
| 4,912,638 | 3/1990 | Pratt, Jr. | 364/413.02 |
| 4,971,069 | 11/1990 | Gracovetsky | 128/781 |
| 5,014,719 | 5/1991 | McLeod | 128/774 |
| 5,052,375 | 10/1991 | Stark et al. | 128/25 R |

OTHER PUBLICATIONS

Don B. Chaffin et al. Occupational Biomechanics, pp. 105, 130 to 133, 199 to 201, 205, 211 (1984).

The Pneumex Rehabilitation Cylinder, Advertising brochure (undated).

The CYBEX LIFTASK, Advertising brochure (undated).

*Primary Examiner*—Max Hindenburg
*Assistant Examiner*—Guy V. Tucker
*Attorney, Agent, or Firm*—Robic

[57] ABSTRACT

An apparatus for the rehabilitation of the musculoskeletal performance of a human body, comprising a handle and a set of three cylinders capable of longitudinal extension and retraction, the cylinders extending at angle with respect to each other and each having one end rotatably connected to the handle and another end rotatably connected to a rigid surface, the ends of the three cylinders opposite the handle being spaced apart from each other. By adjustably and independently controlling the longitudinal extension and retraction of each of the cylinders, it becomes possible to simulate objects being lifted or moved on the job at various heights and in any particular angle and plane and thus use the apparatus for rehabilitation purpose. The apparatus may also comprise strain gauges preferably located between the end of each cylinder attached to the rigid surface and the corresponding rigid surface in order to measure the strain applied by the human body to the handle, this measured strain being indicative of the musculoskeletal performance. Thus, it becomes possible to use the apparatus for diagnostic purpose, such as, for example to make isometric and isokinetic measurements of the musculoskeletal performance of the human body, by locking the cylinders and allowing the same to extend or retract, respectively.

15 Claims, 3 Drawing Sheets

FIG. 1
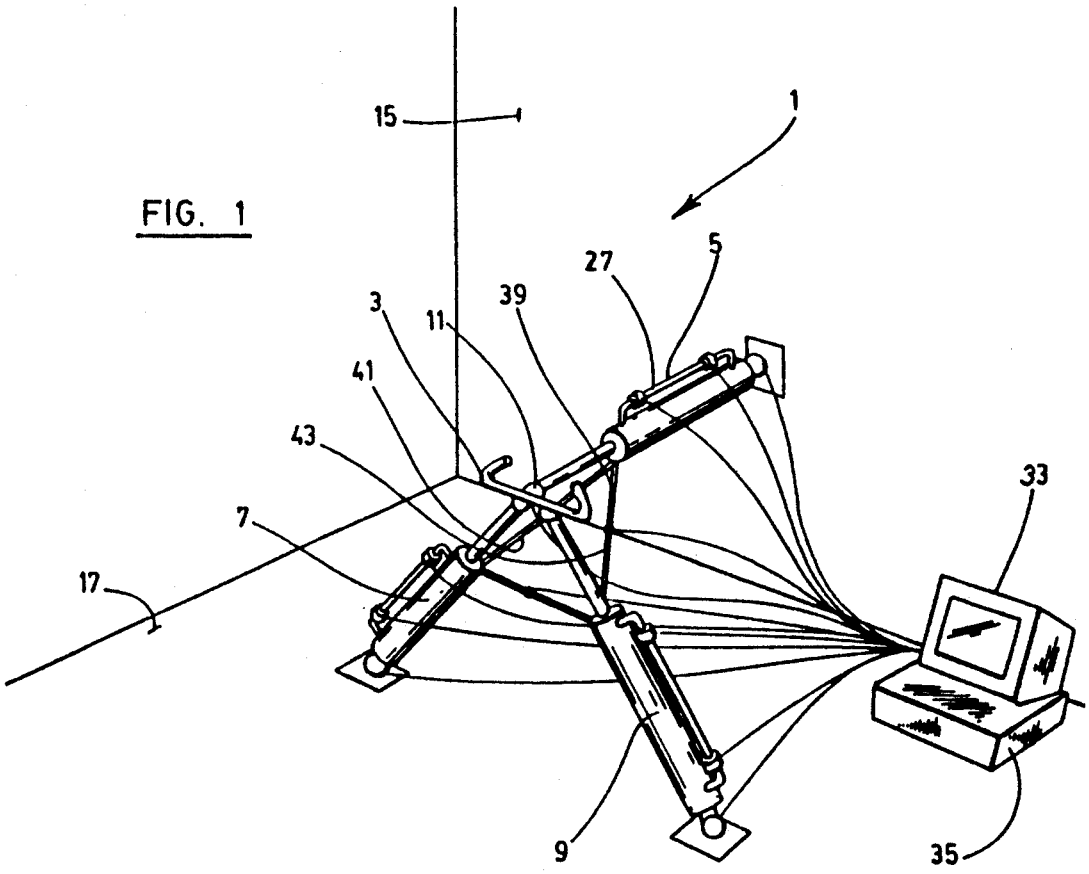
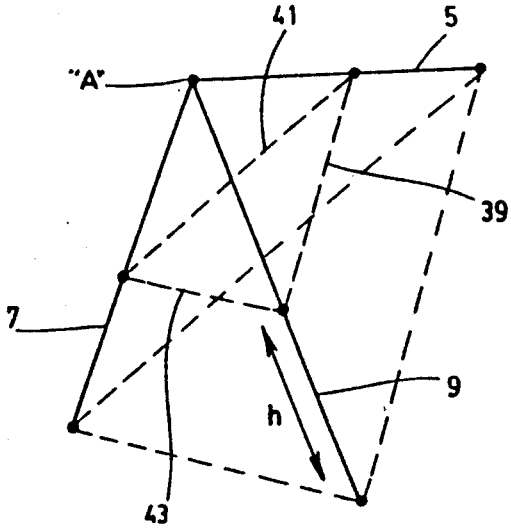
FIG. 2

APPARATUS FOR THE REHABILITATION AND MEASUREMENT OF MUSCULOSKELETAL PERFORMANCES

BACKGROUND OF THE INVENTION a) Field of the Invention

The present invention relates to an apparatus for the rehabilitation and, optionally, measurement of the musculoskeletal performance of a human body.

b) Brief Description of the Prior Art

Numerous apparatus are presently available in the market, for use in the rehabilitation of "parts" of the body of a patient, such as his or her wrist, shoulder ankle, knee or back.

These apparatuses which can be of very different structures, usually incorporate strain gauges or similar devices that make them also useful for measuring the isometric and/or isokinetic musculoskeletal performance of the patient.

A first example of such an apparatus is the one sold by PNEUMEX, INC. of Edmonton, Alberta, under the tradename "The Pneumex rehabilitation cylinder". This apparatus comprises a pneumatic cylinder that can be attached at one end by a suction cup and an universal joint to any non porous surface, and at the other end to the foot, knee, arm or wrist of the patient. The piston head within the cylinder define two chambers that are connected by a pneumatic line incorporating two manually adjustable control valves allowing independent pressure on the in and out stroke. A pressure gauge is also provided to give readings on both the in and out stroke.

Another example of apparatus is the one sold by CYBEX, a division of LUMEX, INC., of Ronkonkoma, New York, under the tradename LIFTASK. This other apparatus along with other apparatuses sold by the same company under the tradename of the "Torso Rotation" and "Trunk Extension/Flexion" units, is designed to complete testing, rehabilitation and screening of the back of a patient.

It basically comprises a handle fixed to a rope wound onto a winch whose rotation may be controlled by a motor. It also comprises an electronic load cell and a velocity tranducer connected to a computer to determine both the instantaneous forces and the velocity of motion, where the patient is asked to pull up the handle with his or her arms alone (arm lifting strength test), his or her legs alone (leg lifting strength test), or his or her back (torso lifting strength test).

If the rope is locked in position by preventing the winch from rotating, isometric or "static" measurement of the body performance can be obtained. Depending on the length of the rope and/or the vertical position of the handle (when use is made of other apparatuses of this type further comprising a vertical post along which the winch may be adjusted), it is possible to simulate objects being lifted or moved at various heights. Moreover, the handle can be made removable and replaced by straps, tools, boxes and the like for custom-designed job simulation.

If the rope is allowed to unwind with a given resistance and/or at a given speed, isokinetic or "dynamic" measurements of the body performance can be achieved (dynamic lift strength, dynamic back extension strength, dynamic elbow flexion strength). Of course, the velocity of the movement to be performed can be set by proper adjustment of the motor controlling the winch to meet some motion-distance/time requirements of the simulated job.

Measurements obtained with such an apparatus can be correlated with theoretical values of the compression or torsion forces applied to an articulation, such as, for example, the compression force on the $L_5/S_1$ disc of the spine, which values can be obtained by resolution of mathematical equations applying to the particular structure of the articulation being tested. Thus, it becomes possible to evaluate the performance of a patient and/or the difficulty of a given job and, as a result, determine whether carrying out this job falls within standards like those established by recognized organizations such as the National Institute for Occupational Safety and Health (NIOSH) which, by way of example, has established that predicted $L_5/S_1$ compression values above 3400N be considered as potentially hazardous to some people, and values greater than 6400N as hazardous to everybody.

Other apparatuses are also known, wherein the patient or part of his or her body is rigidly fixed in a vice-like structure that is "articulated" in a single plane. This of course causes the patient to move and perform the required job within this single plane only.

OBJECTS OF THE INVENTION

An object of the present invention is to provide an apparatus that is very simple in structure and yet very versatile and efficient in operation, for use in the rehabilitation of the musculoskeletal performance of a human body, especially his or her torso lifting strength. With this apparatus, it is possible in particular to simulate objects of any preselected size and weight being lifted and moved at various heights and in any particular angle and plane, thereby allowing custom-designed job simulation and thus efficient rehabilitation.

Another object of the invention is to provide an apparatus of the above mentioned type, which incorporates one or more strain-gauges in its structure to make it useful for the evaluation and measurement the musculoskeletal performance of the body of a patient, especially his or her back. With this apparatus, it is in particular possible to make both isometric and isokinetic measurements of the patient's body performance in a very simple and reliable manner.

A further object of the invention is to provide an apparatus of the above mentioned type, which is particularly well adapted for use in combination with, and under the control of an apparatus like the one disclosed and claimed in Applicant's U.S. Pat. No. 4,971,069 issued on Nov. 20, 1990, which apparatus is presently being sold by the Applicant under the trademark SPINOSCOPE for a full three-dimentional dynamic free motion analysis of the trunk, spine, pelvis and intersegmental movement of a patient.

SUMMARY OF THE INVENTION

In accordance with the invention, there is provided an apparatus for the rehabilitation of the musculoskeletal performance of a human body, comprising:

a handle;

a set of at least three cylinders capable of longitudinal extension and retraction, these cylinders extending at angle with respect to each other and each having one end rotatably connected to the handle and another end rotatably connected to a rigid surface, the other ends of the cylinders being spaced apart from each other; and control means for adjustably and independently controlling the longitudinal extension and retraction of each of the cylinders.

Proper actuation and setting of the control means permits to adjust the position of the handle at any desired height and in any particular angle and then to lock this handle to cause the human body to perform a given task such as pulling or pushing the handle, or rotating it like a car steering wheel, in a given position and in a static manner, or, alternatively, to allow this handle to move in any prelected direction and/or plane at a given speed to cause the human body to perform another given task meeting some motion, distance and time requirements in a dynamic manner. Of course, such a control may be assisted by a programmable computer.

In accordance with a preferred embodiment of the invention, the above apparatus may also comprise strain-measuring means to measure the strain applied by the human body to the handle, the measured strain being indicative of the musculoskeletal performance of this human body and thus being useful for the isometric (static) or isokinetic (dynamic) evaluation of this body or of any other motion undertaken.

Such a measurement can be combined with other measurements carried out simultaneously on the patient with, for example, the apparatus disclosed in the above mentioned U.S. Pat. No. 4,971,069, for the dynamic evaluation of the flexibility of the spine of a patient and, as a result of this evaluation, the detection and identification of possible mechanical injuries in some portion of this spine, especially the lumbar portion thereof.

BRIEF DESCRIPTION OF THE DRAWINGS

The invention and its advantages will be better understood upon reading of the following non-restrictive description of a preferred embodiment thereof, made with reference to the accompanying drawings in which:

FIG. 1 is a schematic perspective view of an embodiment of the apparatus according to the invention;

FIG. 2 is a schematic, diagramm showing how the angular portion of each cylinder of the apparatus can be determined with respect to each other;

DESCRIPTION OF A PREFERRED EMBODIMENT

Figure 3:
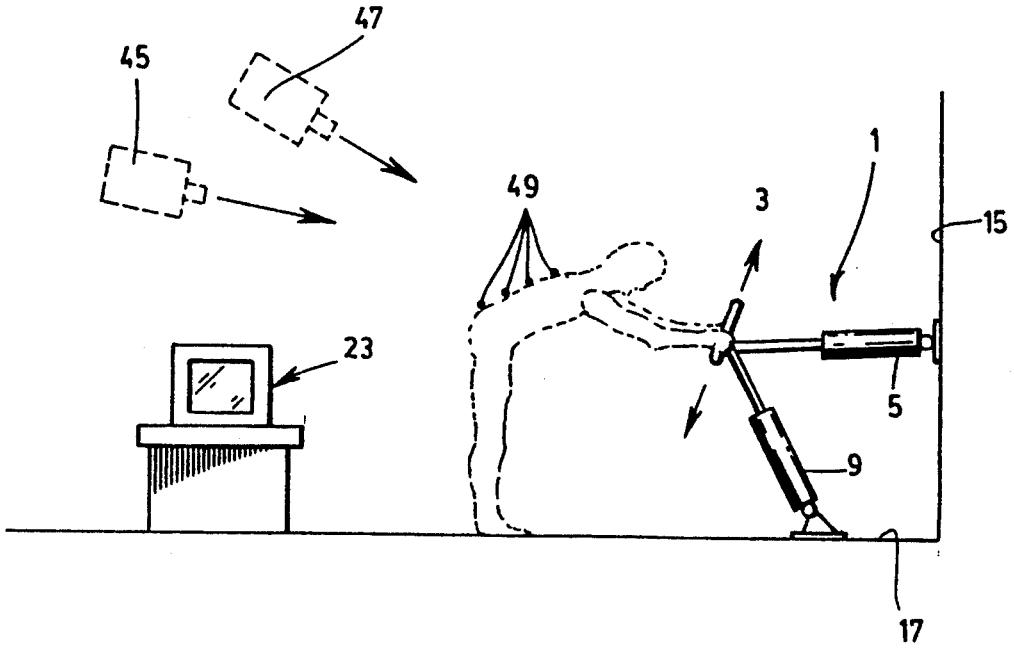
FIG. 3 is a schematic representation of the apparatus according to the invention in use with the apparatus of U.S. Pat. No. 4,971,069.

The apparatus 1 according to the invention as shown in FIG. 1, comprises an interchangeable handle 3 that can be replaced, whenever desired, by other handles of different size and/or shape, the word "handles" including straps, tools, boxes and the like, for any kind of job simulation.

The apparatus 1 also comprises a set of preferably three cylinders 5, 7, 9 capable of longitudinal extension and retraction. The cylinders extend at angle with respect to each other and each of them, say cylinder 5, has one end 11 rotatably connected to the handle 3 and another end 13 rotatably connected to a rigid surface 15 through any kind of universal joint, such a ball-and socket joint. Two of the three cylinders of the set, namely those numbered 7 and 9 are preferably connected to a same horizontal surface 17 which acts as a floor on which the patient may stand up. The third cylinder 5 of the set is preferably connected to the surface 15 that is vertical and perpendicular to the horizontal surface, this vertical surface being, for example, the wall of the room in which the apparatus is mounted. This vertical surface preferably extends at equal distance from the bottom ends of the two other cylinders connected to the horizontal surface or floor 17.

Thus, the ends of the three cylinders opposite the handle 3 are spaced apart from each other to give the resulting structure a pyramidal shape which can be modified depending on the extension or retraction state of each cylinder. The base of the pyramid can be varied as needed, by changing the relative position of the attachment points of the cylinders.

Figure 4:
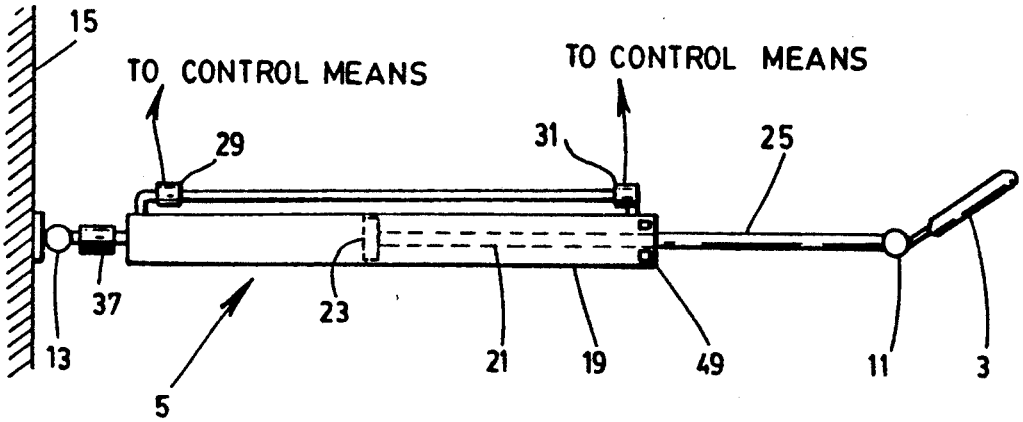
FIG. 4 is a side elevational view of one of the cylinders of the apparatus, operating in a passive way.

Referring to FIG. 4 which shows a first embodiment of the invention, each cylinder comprises a hollow barrel 19 filled up with a fluid that is preferably compressible, such as air. Each cylinder also comprises a piston 21 including a piston head 23 slidably mounted within the barrel and a piston rod 25 having a free end extending outwards the barrel at one end thereof. The piston head 23 divides the barrel 19 into two separate chambers that are connected to each other by means of a fluid pipe 27 extending between the opposite ends of the barrel. The fluid pipe 27 is in fluid communication with the chambers of the barrel to place these chambers in fluid communication with each other.

Adjustable valve means including two separately adjustable, electrically-operated control valves 29, 31 are mounted onto the fluid pipe 27 to control fluid flow within this pipe. These control valves are part of control means 33 (see FIG. 1) that will be described hereinafter and are intended to be used for independently controlling the fluid flow on the in and out stroke of the piston 21.

Figure 5:
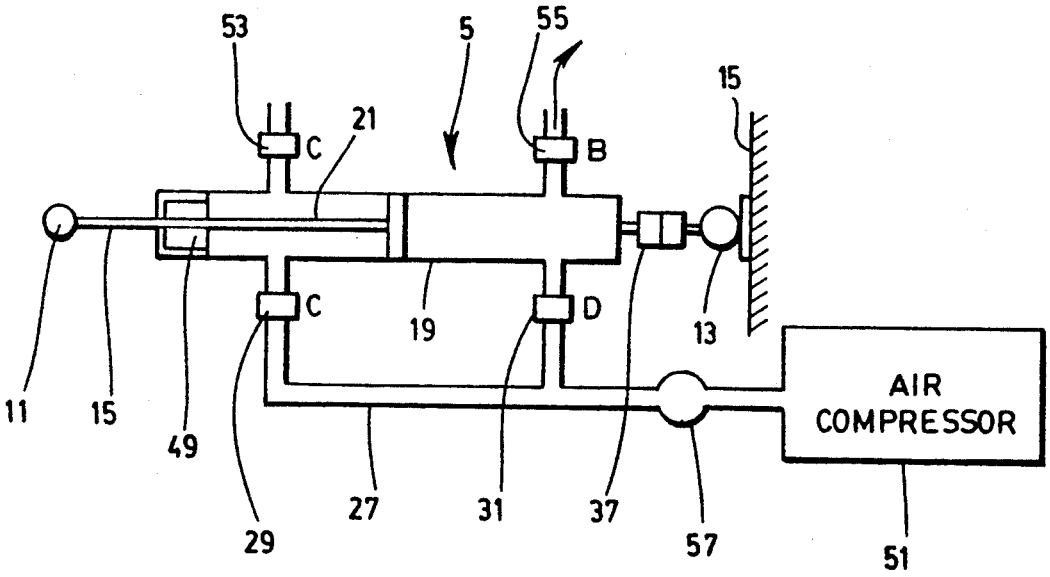
FIG. 5 is a side elevational view of a one of the cylinders of the apparatus, operating in an active way.

The apparatus using cylinders as shown in FIG. 4 may only work in a passive manner. The same apparatus may however be made workable in a dynamic or active manner if use is made of cylinders like the one shown in FIG. 5, connected to a power source, such as an air compressor 51. In this FIG. 5, the components of the cylinder that are similar to those shown in FIG. 4, have been identified by the same reference numerals. Each chamber of the barrel is provided with an electrically-operated exit valve 53, 55 allowing air to escape to atmosphere. The chambers of the barrel are also interconnected by a fluid pipe 27 incorporating the same kind of electrically-operated control valve 29, 31 as disclosed hereinabove, the only difference being that the pipe 27 is connected to the air compressor 51 via a further control valve 57. Of course, valves 29, 31, 53, 55 and 57 are parts of the control means 33 previously disclosed. If valves 53, 55 and 57 are closed, the cylinder 5 is similar to the one shown in FIG. 4 and thus has a passive configuration. If, however, valves 53 and 31 are closed and valves 57, 29 and 55 are opened, the piston 21 will move to the left and thus will be activated in a controllable manner. Of course, the piston 21 may similarly be moved to the right.

The purpose of the control means 33 is to adjustably and independently control the longitudinal extension and retraction of each of the cylinders 5, 7 and 9.

Electromagnetic brakes 49 (see FIG. 4) or any similar devices that are also part of the control means 33, may be incorporated into the cylinders to lock the pistons or anyone of them whenever desired, so that its or their length(s) remain(s) fixed.

Adjustment of the control valves and/or actuation of the brakes can be made manually. However, adjustment of the valves and actuation of the brakes are preferably made under control of a programmable computer 35 capable of monitoring and adjusting the valves to adjust the fluid flow according to any preselected pattern and at any predetermined speed and/or to lock any cylinder at a given state of extension to cause the handle 3 to move in any spatial direction by proper extension and retraction of the three cylinders.

Thus, proper actuation and setting of the control means permit to adjust the position of the handle 3 at any desired height and in any particular angle and then to lock this handle to cause the human body to perform, a given task in a given position and in a static manner, or alternatively, to allow this handle to move in any preselected direction and/or plane at a given speed to cause the human body to perform another given task meeting some motion, distance and time requirements in a dynamic manner.

In accordance with a particularly preferred embodiment of the invention, the apparatus 1 may also comprise strain-measuring means to measure the strain applied by the patient to the handle 3 during a job, the measured strain being indicative of the musculoskeletal performance of this patient and thus useful for the isometric or isokinetic evaluation of this patient.

The strain-measuring means may consist of one single strain-gauge connected between the joining ends of the cylinders and the handle. However, for better application and evaluation of the strain applied to the whole system, use is preferably made of a set of three signal-emitting strain-gauges such as 37 (FIG. 4) operatively connected to the three cylinders between the ends thereof that attached to the floor or to the wall, and the corresponding floor or wall.

Means are provided to determine the angular position of each cylinder with respect to the others. These means are connected to means forming part of the computer 35 to compute the signals received from all the strain-gauges as a function of the determined angular position of each cylinder and thus give a proper evaluation of the strain applied to the handle 3, in both strength and direction.

The means to determine the angular position of each cylinder with respect to each other may consist of electronic measuring tapes 39, 41 and 43 mounted between the cylinders 9 and 5, 5 and 7, and 7 and 9 respectively, at a same given height "h" from the ends of these cylinders connected to the floor or wall (see FIG. 2). Each tape gives a signal indicative of its length, which is equal to the distance separating each pair of piston at said given height.

As the distances between the ends of the cylinders connected to the floor and wall are set and known, it becomes very easy from the signals received from the tapes, to mathematically determine the position of the apex "A" of the pyramid where the handle 3 is mounted, and its speed, and thus determine where this handle is located in the space with respect to the floor 17 and wall 15, in view of controlling the same.

The means to determine the angular position of each cylinder with respect to each other may also consist of electronic measuring tapes for measuring the length of travel of each piston. Since, once again, the distances between the ends of the cylinders connected to the floor and wall are set and known and the length of the barrel of each cylinder is also known, it becomes very easy to mathematically determine the position of the apex "A" of the pyramid.

Alternatively, use could be made of LED's connected to the ends of each cylinder and of a set of two spaced-apart cameras 45, 47 (see FIG. 3) to track these LED's and determine their spatial position in the room to determine in turn the position of the handle 3, substantially in the same manner as such a tracking is carried out on LED's attached to the patient's back in the SPINOSCOPE apparatus forming the subject matter of U.S. Pat. No. 4,971,069.

In all cases, calibration means known per se may be provided if necessary.

In the above description, it has been mentioned that all the cylinders are rotatably connected to the handle 3. It is worth mentioning however that these cylinders could be connected to each other by pair, or to any other element in a cantilever manner, thereby making it possible to generate torques in the handle 3 whenever desired such as, for example, to simulate actuation of a driving wheel. Alternatively, the same torques could be generated by an additional cylinder or a small pneumatic motor mounted at the junction of the three cylinders with the handle.

As mentioned hereinabove, the apparatus 1 is particularly well adapted for use in combination with, and under the control of the apparatus known as SPINOSCOPE and disclosed in Applicant's U.S. Pat. No. 4,971,069, which apparatus is shown in very schematic manner in FIG. 3 and is presently in use for the non-invasibe evaluation of the flexibility of the spine of a patient and the detection and identification of possible mechanical injuries in the lumbar portion of this spine. In such a case, the computer of the SPINOSCOPE can be used to control the apparatus 1 to move the handle in different directions (up and down, right or left, etc...) while monitoring with the cameras 45, 47, the relative positions of skin-markers 49 mounted on the back of the patient in the midline of his spine and on the crest of his or her iliums, while this patient holding the handle 3 during this measurement.

Numerous modifications or additions could be made to the above described invention without departing from the scope of the appended claims.

Thus, by way of example, use could be made of any kind of electrically, pneumatically or hydraulically powered element linearly extensible and retractable in place of the cylinders 5, 7 and 9. The word "cylinder" must therefore be interpreted as encompassing such "elements".

We claim:

1. An apparatus for the rehabilitation of the musculoskeletal performance of a human body, comprising:

a handle;

a set of at least three longitudinally extensible and retractable cylinders, said cylinders extending at angle with respect to each other and each having a first end rotatably connected to the handle and a second end longitudinally opposite to said first end and rotatably connected to a rigid surface, said second ends of said cylinders being spaced apart from each other; and control means for adjustably and independently controlling longitudinal extension and retraction of each of said cylinders in such a manner as to adjust the position of the handle at any desired height and in any desired angle with respect to said rigid surface, wherein said handle is connected to said rigid surface exclusively through said cylinders whereby the handle is free to move in any desired direction.

2. The apparatus of claim 1, further comprising:

strain-measuring means to measure the strain applied by the human body to the handle, said measured strain being indicative of the musculoskeletal performance of said human body.

3. The apparatus of claim 2, wherein said strain measuring means comprises:

a signal-emitting strain-gauge operatively connected to each of said cylinders between the second end thereof and the corresponding rigid surface, means to determine the angular position of each cylinder with respect to the others, and means to compute the signals received from all the strain-gauges as a function of the determined angular position of each cylinder.

4. The apparatus of claim 1, wherein each of said cylinder comprises:

a hollow barrel filled up with a fluid, said barrel having a pair of opposite ends;

a piston comprising a piston head slidably mounted within the barrel, said piston head dividing said barrel into two separate chambers, and a piston rod having a free end extending outwards the barrel at one of the opposite ends thereof;

a fluid pipe extending between said opposite ends of said barrel, said fluid pipe being in fluid communication with the chambers of said barrel to place said chambers in fluid communication with each other; and adjustable valve means to control fluid flow within said fluid pipe, said valve means being part of said control means.

5. The apparatus of claim 4, wherein the adjustable valve means of each of said cylinder includes two separately adjustable control valves to independently control the fluid flow on the in and out stroke of the piston.

6. The apparatus of claim 1, wherein two of the three cylinders of the set have their second ends connected to a same horizontal surface acting as their respective rigid surfaces, and wherein a third cylinder of the set has its second end connected to a vertical surface perpendicular to said horizontal surface, said vertical surface acting as the rigid surface of said third cylinder and extending at equal distance from the second ends of the two cylinders connected to the horizontal surface.

7. The apparatus of claim 6, wherein said horizontal surface is a floor on which said human body may stand up.

8. An apparatus for the rehabilitation of the musculoskeletal performance of a human body comprising:

a handle;

a set of at least three longitudinally extensible and retractable cylinders, said cylinders extending at angle with respect to each other and each having a first end rotatably connected to the handle and a second end longitudinally opposite to said first end and rotatably connected to a rigid surface, said second ends of said cylinders being spaced apart from each other; and control means for adjustably and independently controlling longitudinal extension and retraction of each of said cylinders in such a manner as to adjust the position of the handle at any desired height and any desired angle with respect to said rigid surface, wherein said handle is connected to said rigid surface exclusively through said cylinders whereby the handle is free to move in any desired direction wherein each of said cylinders comprises;

a hollow barrel filled up with a fluid, said barrel having a pair of opposite ends;

a piston comprising a piston head slidably mounted within the barrel, said piston head dividing said barrel into two separate chambers, and a piston rod having a free end extending outwards the barrel at one of the opposite ends thereof;

a fluid pipe extending between said opposite ends of said barrel, said fluid pipe being in fluid communication with the chambers of said barrel to place said chambers in fluid communication with each other; and adjustable valve means to control fluid flow within said fluid pipe, said valve means being part of said control means and including two separately adjustable control valves to independently control the fluid flow on the in and out stroke of the piston, and wherein:

each chamber of the barrel is provided with a separately adjustable exit valve; and the fluid pipe is connected via an adjustable control valve to a power source consisting of a source of pressurized fluid forming part of said control means;

wherein, by properly adjusting the three control valves and two exit valves of each cylinder, dynamic actuation of each cylinder may be obtained.

9. The apparatus of claim 6, further comprising:

strain-measuring means to measure the strain applied by the human body to the handle, said measured strain being indicative of the musculoskeletal performance of said human body.

10. The apparatus of claim 9, wherein said strain measuring means comprises:

a signal-emitting strain-gauge operatively connected to each of said cylinders between the second end thereof and the corresponding rigid surface, means to determine the angular position of each cylinder with respect to the others, and means to compute the signals received from all the strain-gauge as a function of the determined angular position of each cylinder.

11. The apparatus of claim 10, wherein two of the three cylinders of the set have said second ends connected to a same horizontal surface acting as their respective rigid surfaces, and where a third cylinder of the set has its second end connected to a vertical surface perpendicular to said horizontal surface, said vertical surface acting as the rigid surface of said third cylinder and extending at equal distance from the second ends of the two cylinders connected to the horizontal surface.

12. The apparatus of claim 11, wherein said control means includes a programmable computer.

13. The apparatus of claim 10, wherein said control means includes a programmable computer.

14. An apparatus for the rehabilitation of the musculoskeletal performance of a human body, comprising:

a) a handle;

b) a set of at least three longitudinally extensible and retractable cylinders, said cylinders extending at angle with respect to each other and each having a first end pivotably connected to the handle and a second end longitudinally opposite to said first end and pivotably connected to a rigid surface, the second ends of said cylinders being spaced apart from each other; and c) control means for adjustable and independently controlling longitudinal extension and retraction of each of said cylinders, said control means comprising:

a power source operatively connected to each of the cylinders to actuate the same and cause said longitudinal extension and retraction of said cylinders, and a programmable computer connected to said power source and to said cylinders to monitor and control said longitudinal extension and retraction of said cylinders in such a manner as to move the handle along a preselected path at a preselected speed in order to force the human body to perform a given task meeting some motion, distance and time requirements in a dynamic manner;

d) wherein said handle is connected to said rigid surface exclusively through said cylinders whereby the handle is free to move in any desired direction.

15. The apparatus of claim 14, further comprising:

strain-measuring means to measure the strain applied by the human body to the handle, said measured strain being indicative of the musculoskeletal performance of said human body.

* * * * *